United States Patent [19]

Beimesch

[11] Patent Number: 4,537,696

[45] Date of Patent: Aug. 27, 1985

[54] HYDRAULIC FLUIDS BASED ON TWO CENTISTOKE SYNTHETIC HYDROCARBONS

[75] Inventor: Bruce J. Beimesch, Crescent Springs, Ky.

[73] Assignee: National Distillers and Chemical Corporation, New York, N.Y.

[21] Appl. No.: 537,772

[22] Filed: Sep. 30, 1982

Related U.S. Application Data

[63] Continuation-in-part of Ser. No. 419,894, Sep. 20, 1982, abandoned.

[51] Int. Cl.[3] ..... C10M 3/12; C07C 2/74

[52] U.S. Cl. ..... 252/75; 252/32.7 E; 252/51.5 A; 252/74; 252/76; 585/10; 585/255

[58] Field of Search ..... 252/32.7 E, 51.5 A, 252/74, 76, 75; 585/10, 255

[56] References Cited

U.S. PATENT DOCUMENTS

| | | | |
|---|---|---|---|
| 3,450,636 | 6/1969 | Rausch | 252/73 |
| 3,742,082 | 6/1973 | Brennan | 585/255 |
| 3,763,244 | 10/1973 | Shubkin | 585/255 |
| 4,032,591 | 6/1977 | Cupples et al. | 252/73 |
| 4,101,427 | 7/1978 | Shaub | 252/32.7 E |

OTHER PUBLICATIONS

Hatton, *Introduction to Hydraulic Fluids*, Reinhold Publishing Corp., New York, 1962, Chapter 6, p. 171.

*Primary Examiner*—Paul Lieberman
*Assistant Examiner*—Robert A. Wax
*Attorney, Agent, or Firm*—Kenneth D. Tremain; Gerald A. Baracka

[57] ABSTRACT

Highly useful hydraulic fluids based on synthetic hydrocarbon basestocks and having improved low temperature properties, good shear stability, and capable of substantially meeting the rigid Denison HF-O standards are provided. The products of this invention are comprised of specific proportions of a two centistoke synthetic hydrocarbon oil obtained from the oligomerization of alpha-olefins, particularly 1-decene, specific polymethacrylate viscosity index improvers, and a zinc-based universal/multifunctional additive package. The hydraulic fluids have a maximum viscosity of 1400 centistokes at −40° F. and minimum viscosity of 5.5 centistokes at 210° F.

5 Claims, No Drawings

HYDRAULIC FLUIDS BASED ON TWO CENTISTOKE SYNTHETIC HYDROCARBONS

CROSS-REFERENCE TO RELATED APPLICATION

This is a continuation-in-part of copending application Ser. No 419,894, filed Sept. 20, 1982, now abandoned.

BACKGROUND OF THE INVENTION

With the development of sophisticated mobile and industrial hydraulic systems, there is an increasing need for multi-purpose hydraulic fluids to satisfy the stringent requirements of these systems. Since the requirements of hydraulic fluids will vary, depending primarily on the type of pumps used, i.e., gear, piston or vane, fluids must be specifically designed to meet the performance requirements (power transmission, lubrication and cooling) of the particular system and obtain maximum pump life. The characteristics and utility of hydraulic fluids are determined by the base oil used and the particular combination of additives employed for the formulation thereof. Additives are selected to minimize viscosity changes, inhibit corrosion, increase thermal and oxidative stability, reduce wear, etc.

The viscosity of the fluid over the entire range of system operating temperatures is of primary concern for all hydraulic systems. There is a particular problem with mobile hydraulic equipment used in northern regions where nighttime temperatures often reach −40° F. or below. The viscosity of petroleum-based hydraulic fluids in such equipment can exceed the maximum viscosity recommended by the manufacturer for safe startup. This is particularly so in the case of hydraulic equipment which utilizes vane pumps since the maximum recommended cold start viscosity for vane pumps is generally much lower than forpiston or gear pumps. For example, in Denison Bulletin 2002-C the maximum viscosity at cold start recommended for Denison vane equipment is 4000 SUS (862 centistokes) whereas for their piston equipment, the recommended maximum viscosity at cold start is 7500 SUS (1618 centistokes). Thus, following the above guidelines using SUNVIS 816 WR(32), a commercially available petroleum based hydraulic fluid manufactured by Sun Oil Company and approved by Denison as meeting their stringent HF-O standards, it would be possible to effect safe startup of piston pumps only at temperatures above about 5° F. and vane pumps should only be started at temperatures of about 15° F. or above. The hydraulic fluids should also maintain the initial viscosity characteristics under actual operating conditions and should not breakdown under stress and shear forces.

It would be highly advantageous, therefore, if hydraulic fluids were available which had improved low temperature viscosities permitting the safe startup of hydraulic equipment, particularly vane equipment, at lower temperatures than was heretofore possible. It would be even more advantageous if such fluids were based on readily available synthetic hydrocarbon oils and if these products had good shear stability and substantially met the Denison HF-O standards in regard to thermal stability, oxidative stability, hydrolytic stability and resistance to sludge formation and metal corrosion.

SUMMARY OF THE INVENTION

We have now quite unexpectedly discovered synthetic hydraulic fluids based on two centistoke synthetic hydrocarbon oil obtained from the oligomerization of alpha-olefins which have significantly improved low temperature properties and satisfy all of the abovementioned requirements. By utilizing the fluids of this invention, it is possible to effect safe startup of hydraulic equipment, particularly vane equipment, at much lower temperatures than was previously possible.

To obtain the present improved hydraulic fluids, a two centistoke synthetic hydrocarbon is formulated with specific viscosity index (VI) improvers and specific zinc-based universal/multifunctional additive packages. The improved hydraulic fluids of this invention are comprised of from about 70 to 87 percent by weight synthetic hydrocarbon, 12 to 30 percent by weight VI improver and 0.25 to 3.0 percent by weight zinc-based universal/multifunctional additive package.

Synthetic hydrocarbons employed for the formulations have 210° F. viscosities in the range 1.6 to 2.2 centistokes and preferably are dimeric products obtained from the oligomerization of 1-decene. Useful VI improvers have weight average molecular weights of 20,000 to 70,000. Polymethacrylate VI improvers are utilized forthese fluids. The zinc-based universal/multifunctional additive packages are typically derived from zinc dithiophosphate or other zinc compounds and contain phosphorous, sulfur and from about 3 to 8 percent zinc. The universal/multifunctional additive package must be of a type and used in an amount such that the finished hydraulic fluids will substantially meet the Denison HF-O standards. The improved hydraulic fluids of this invention have a minimum viscosity of 5.5 centistokes at 210° F., maximum viscosity of 1400 centistokes at −40° F., and viscosity index of 230 or above. Furthermore, the change in the 210° F. viscosity of the fluids will not exceed 3 percent under the shear conditions of the ASTM D-3945B Shear Injector Test. Especially useful hydraulic fluids contain 75 to 85 percent two centistoke synthetic hydrocarbon, 0.5 to 1.5 percent of the zinc-based additive package and 18 to 25 percent of the polymethacrylate VI improver having a weight average molecular weight of 40,000 to 60,000.

DETAILED DESCRIPTION OF THE INVENTION

The improved hydraulic fluids of this invention are based on two centistoke synthetic hydrocarbons obtained by the oligomerization of alpha-olefins. Processes for the production of oligomers from alpha-olefins are well known and the two centistoke synthetic hydrocarbon oil can be obtained by conventional cationic polymerization procedures described in the literature. By way of illustration reference may be had to U.S. Pat. Nos. 3,149,178, 3,763,244 and 3,780,128. These references describe the batch oligomerization of alpha-olefins, such as 1-decene, using a boron trifluoride catalyst in combination with a promoter such as an alcohol or water. Dimer, trimer, tetramer and higher oligomers are formed in these processes. The dimer fraction which has a viscosity (210° F.) of about 2 centistokes is separated from the higher oligomers by fractional distillation. The fraction containing the higher oligomeric products and which typically has a 210° F. viscosity between about 4 and 8 centistokes is utilized for the formulation of other lubricant products. In addition to the aforementioned batch type procedures, continuous oligomerization processes have been developed and are described in U.S. Pat. Nos. 4,045,508 and 4,239,930. Dimerization processes whereby two centistoke fluids are produced as the major product directly from alpha-olefins are also known.

The two centistoke synthetic hydrocarbon employed for the preparation of the improved hydraulic fluids of this invention consists predominantly of dimeric products derived from 1-decene or an alpha-olefin mixture containing a major proportion of 1-decene. Other alpha-olefins which can be present in minor amounts in the oligomerization process can have from about 4 to 14 carbon atoms but are primarily 1-octene and 1-dodecene. Preferably the two centistoke fluid will be derived from alpha-olefins containing at least 75 percent by weight 1-decene and dimers derived from alpha-olefins containing 90 percent by weight or more 1-decene are especially advantageous. The dimer fraction, obtained by oligomerization of the above described alpha-olefins and fractionally distilled from the higher oligomeric moieties, generally contains less than 25 percent and, more preferably, less than 10 percent trimer and higher oligomers.

Synthetic hydrocarbon base oils used for the preparation of hydraulic fluids should be essentially saturated. Therefore, the dimer fraction as obtained from the above-described oligomerization processes and which contains olefinic unsaturation, must be hydrogenated prior to use. This can be accomplished in the oligomerization process before fractionation or the oligomeric product can first be fractionated and the dimer fraction separately hydrogenated. For the purpose of this invention, it will be understood that although the synthetic hydrocarbon fluids are referred to as two centistoke materials, they can have 210° F. viscosities in the range 1.6 to 2.2 centistokes. The −65° F. viscosity of such synthetic hydrocarbon products is typically less than 2000 centistokes.

Specific polymethacrylate viscosity index (VI) improvers are required to meet the viscosity index requirements and shear stability requirements of the finished fluid. This is accomplished by the use of polymethacrylate copolymer VI improvers having weight average molecular weights in the range 20,000 to 70,000. The weight average molecular weight refers to the weight average molecular weight of the polymer portion of the VI improver. The polymethacrylate copolymers have intrinsic viscosities of 0.020 to 0.070. Polymethacrylate copolymer VI improvers wherein the polymer has a weight average molecular weight in the range 40,000 to 65,000 and intrinsic viscosity of 0.040 to 0.065 are especially useful for the formulation of hydraulic fluids of this invention.

The VI improvers must also be compatible with and soluble in the synthetic two centistoke hydrocarbon oil. Furthermore, since commercial VI improvers are viscous concentrates of the polymer or copolymer in a hydrocarbon diluent, typically a solvent refined neutral carrier oil, the flashpoint of the diluent must be such that it does not lower the flashpoint of the formulated hydraulic fluid. Generally the minimum flashpoint of the VI improver is 300° F.

Especially useful polymethacrylate copolymer viscosity index improvers which can be employed for the preparation of the improved hydraulic fluids of this invention include Acryloid® 1017 and Acryloid® 1019 (manufactured by the Rohm and Haas Company) and Texaco TC-10124 (manufactured by the Texaco Chemical Company).

By utilizing the above-defined VI improvers, hydraulic fluids having a minimum viscosity at 210° F. of 5.5 centistokes, maximum viscosity at −40° F. of 1400 centistokes, and viscosity index of at least 230 are obtained. Additionally, fluids formulated with these VI improvers are shear stable, i.e., have less than 3 percent and, more preferably, less than 2.25 percent decrease in 210° F. viscosity in the ASTM D-3945B Shear Injector Test.

In addition to the above-defined viscometrics, the hydraulic fluids of this invention also substantially meet all of the stringent Denison HF-O standards with regard to thermal stability, oxidative stability, hydrolytic stability and resistance to sludge formation/metal corrosion. The Denison HF-O standards are as follow:

| | |
|---|---|
| SLUDGE AND METAL CORROSION (To be conducted at the end of a 1000 hour Oxidation Test per ASTM D-943) | |
| Neutralization Value (ASTM D-974) | 2.0 mg. KOH (Max) |
| Insoluble sludge in oil and water layers plus the adhering to the catalyst coils or test tube | 200 mg. (Max) |
| Metal in combined oil, water and sludge | |
| Copper | 50 mg. (Max) |
| Iron | 50 mg. (Max) |
| THERMAL STABILITY (Results after 168 hours of oven test @ 135° C. per Cincinnati Milacron P-75 Procedure) | |
| Sludge | 100 mg. (Max) |
| Copper Wt. loss | 10 mg. (Max) |
| HYDROLYTIC STABILITY (ASTM D-2619) | |
| Copper specimen wt. loss | 0.20 mg./cm$^2$ (Max) |
| Acidity of water layer | 4.0 mg. KOH (Max) |

A zinc-based universal/multifunctional additive package is necessary for this purpose. Such thermally stable zinc-containing additives are known throughout the industry and can be based on zinc dithiophosphates or other zinc compounds. The universal or multifunctional additive packages employed for the present invention enable the base oil to meet the severe Denison HF-O standards with respect to sludge and metal corrosion, thermal stability, and hydrolytic stability without the use of additional stabilizers, inhibitors or the like.

Especially advantageous zinc-based universal/multifunctional additive packages of the above types typically contain 3–8 percent zinc, 2.5–6 percent phosphorus and 5–14 percent sulfur. Commercially available additives of this type include Hitec® E-9191 (manufactured by Edwin Cooper Division of the Ethyl Corporation), Lubrizol 5175A (manufactured by the Lubrizol Corporation), and Elco 130A (manufactured 25 by the Elco Corporation). Zinc, phosphorus and sulfur values for the above-mentioned products, per manufacturer specifications, are as follow:

| | E-9191 | 5175A | 130A |
|---|---|---|---|
| % Zinc | 3.3 | 7.0 | 5.4 |
| % Phosphorus | 2.7 | 4.9 | 5.8 |
| % Sulfur | 6.0 | 9.8 | 13.2 |

To obtain the improved hydraulic fluids, about 70 to 87 percent by weight of the synthetic hydrocarbon is blended with from 12 to 30 percent VI improver and from 0.25 to 3.0 percent of the additive package. Particularly useful formulations contain from 75 to 85 percent two centistoke synthetic hydrocarbon, 18 to 25 percent VI improver, and 0.5 to 1.5 percent of the zinc-based universal/multifunctional additive.

While additional stabilizers and additives are not necessary, they can be included. It may also be desirable to include a dye and/or antifoam agent in the parts per million range.

The following examples illustrate the invention more fully but are not intended as a limit on the scope thereof. In the examples, all parts and percentages are given on a weight basis unless otherwise indicated.

EXAMPLE I

A hydraulic fluid was prepared based on a two centistoke synthetic hydrocarbon obtained from the oligomerization of 1-decene. The synthetic oil, which was hydrogenated and contained 99.8 percent $C_{20}$ dimer, had 210° F. and −65° F. viscosities of 1.8 and 1400 centistokes, respectively. For the hydraulic formulation, 77.9 parts of the synthetic hydrocarbon oil were combined with 21 parts polymethacrylate viscosity index improver (Acryloid® 1019; weight average molecular weight 55,600; intrinsic viscosity 0.0557) and 1.1 parts of a zinc-containing universal antiwear hydraulic additive package (Hitec® E-9191 manufactured by Edwin Cooper Division of the Ethyl Corporation). The resulting formulation had a 210° F. viscosity of 6.1 centistokes, −40° F. viscosity of 1393 centistokes and viscosity index of 270. When tested for shear stability in accordance with ASTM D-3945B, less than 2 percent reduction in the 210° F. viscosity was obtained.

The hydraulic fluid satisfied the thermal stability and hydrolytic stability requirements of the Denison HF-O standards as is evident from the following test results:

| | |
|---|---|
| HYDROLYTIC STABILITY (ASTM D-2619) | |
| Weight Loss of Copper | 0.02 mg/cm$^2$ |
| Acidity of Water Layer | 0.45 mg. KOH |
| THERMAL STABILITY (Milacron P-75) | |
| Sludge | 11 mgs. |
| Weight Loss of Copper | 0.9 mg. |

Results of testing for sludge and metal corrosion in accordance with ASTM D-943 were as follows:

| | |
|---|---|
| Acid Value (Δ @ 1000 hours) | 0.44 |
| Sludge | 70.0 mgs. |
| Copper | 109.3 mgs. |
| Iron | 0.25 mg. |
| Copper in Sludge | 0% |
| Copper in Oil | 400 ppm |
| Copper in Water Layer | 165 ppm |

In view of the oxidative, thermal and hydrolytic stability of the fluid, it is acceptable for use in axial piston and vane equipment used for severe duty service and operated at full rated performance. Furthermore, in view of the favorable viscometrics of the product, the fluid permits the operation of hydraulic equipment at significantly lower temperatures than was heretofore possible. For example, following the recommendations for cold starts in Denison Bulletin 2002-C, vane equipment filled with this fluid could be safely started at a temperature of −30° F. and still be within the maximum viscosity limit recommended for cold start of 862 centistokes. The low-temperature startup capabilities of piston equipment using this oil is even more impressive—down to as low as −43° F. It is evident from the foregoing that the low-temperature capabilities of both vane and pump equipment can be substantially improved over that obtained using the approved petroleum-based products by using the instant synthetic hydraulic fluids based on two centistoke synthetic hydrocarbon. Additionally, even though petroleum-based products such as MIL-H 5606 fluids initially provide start up capabilities down to about −50° F., the shear stability of these fluids is unacceptable and significant changes in viscosity occur. For example, after two hours use under actual operating conditions in a Vickers EQ 25-35 vane pump, the viscosity of a typical MIL-H 5606 fluid was reduced from 5.82 centistokes (initial viscosity) to 4.89 centistokes—a loss in viscosity of approximately 16 percent. Even more significantly, the −65° F. viscosity of the fluid increased from 2537 centistokes to 3309 centistokes—an increase of over 30 percent.

EXAMPLE II

Similar to Example I, a hydraulic fluid was prepared by blending the two centistoke synthetic hydrocarbon oil, viscosity index improver, universal additive package and phenolic anti-oxidant as follows:

| | Parts |
|---|---|
| Synthetic Hydrocarbon Oil | 77.52 |
| Polymethacrylate VI Improver | 19.38 |
| Zn—containing Additive Package | 1.10 |
| 4,4'-Methylenebis(2,6-di-t-butylphenol) | 2.0 |

The product, which had essentially the same viscometrics as the fluid of Example I, was evaluated for hydrolytic stability (ASTM D-2619) and thermal stability (Cincinnati Milacron Test Procedure 75A) with the following results:

| | |
|---|---|
| Hydrolytic Stability (48 hours at 200° F.): | |
| Change in weight of copper (mgs/cm$^2$) | 0.09 |
| Appearance of copper | 1B |
| Acidity of water layer (mgs KOH/gms sample) | nil |
| Thermal Stability: | |
| Sludge (mgs) | 3.4 |
| Appearance of copper rod | 2 |
| Copper weight loss (mgs) | 0.9 |

EXAMPLE III

A hydraulic fluid was prepared using a commercially available two centistoke synthetic polyalphaolefin fluid manufactured by Edwin Cooper Division of the Ethyl Corporation (210° F. viscosity 1.78 centistokes; −40° F. viscosity 298 centistokes; −65° F. viscosity 1397 centistokes). The synthetic hydrocarbon (80 parts) was blended with 18.9 parts of the polymethacrylate viscosity index improver and 1.1 part of the zinc-containing universal antiwear hydraulic antiwear package. The resulting fluid (210° F. viscosity 5.52 centistokes; −40° F. viscosity 1154 centistokes) was a highly effective hydraulic fluid acceptable for use in both vane and piston type equipment. By use of this fluid in a vane pump it was possible to effect safe startups at significantly lower temperatures than is possible with commonly used petroleum-based hydraulic oils. The maximum recommended viscosity for cold start was not exceeded with the above-prepared product at temperatures as low as −32.5° F.

EXAMPLE IV

The formulation of Example III was repeated except that the synthetic hydrocarbon oil used had a viscosity of 1.87 centistokes at 210° F. and contained about 8.3 percent trimer, 1.6 percent tetramer and 0.03 percent higher oligomers. Viscometrics of the resulting fluid were as follows:

| | |
|---|---|
| 210° F. Viscosity | 5.86 centistokes |
| −40° F. Viscosity | 1400 centistokes |

Whereas the fluid was slightly more viscous than the product of Example III, it nevertheless was still possible in vane equipment to meet the viscosity requirements of Denison Bulletin 2002-C for cold starts down to −30° F.

EXAMPLES V–IX

To demonstrate the ability to use other viscosity index improvers and zinc-containing universal/multifunctional additive packages and to vary the ratio of the components, useful hydraulic fluids were formulated as follows:

| | Ex. V | Ex. VI | Ex. VII | Ex. VIII | Ex. IX |
|---|---|---|---|---|---|
| Synthetic Hydrocarbon (210° F. viscosity 1.78 centistokes) | 77.9 | 80.9 | 82.4 | 82.75 | 78.25 |
| Polymethacrylate VI Improver: | | | | | |
| Texaco TC-10124 | 21.0 | 18.0 | 16.5 | 16.50 | — |
| Acrloid ® 1019 | — | — | — | — | 21.0 |
| Zn—containing Additive: | | | | | |
| Hitec ® E-9191 | 1.1 | 1.1 | 1.1 | — | — |
| Elco 130A | — | — | — | 0.75 | 0.75 |
| Viscosity (centistokes): | | | | | |
| 210° F. | 8.30 | 6.85 | 6.22 | 6.14 | 6.10 |
| −40° F. | 1364 | 1022 | 896 | 885 | 1320 |

All of the fluids were shear stable and exhibited excellent oxidative, thermal and hydrolytic stability. They were useful for the lubrication of axial piston and vane pumps, even under severe service conditions, and effectively extended the low temperature startup capabilities of the equipment.

EXAMPLE X

To demonstrate the criticality of the polymethacrylate VI improver, two fluids were prepared utilizing different types of VI improvers. A polyisobutylene VI improver (Lubrizol 3174) was employed for fluid A and an ethylene-propylene copolymer VI improver (Lubrizol 7010) was used for fluid B. For comparative purposes, a fluid (C) formulated in accordance with the present invention utilizing a polymethacrylate VI improver having a weight average molecular weight of 50,476 was also prepared. Details of the formulations and properties of the resulting fluids were as follow:

| | A | B | C |
|---|---|---|---|
| Two-Centistoke Synthetic Hydrocarbon | 79.12 | 79.12 | 79.12 |
| Polyisobutylene VI Improver | 19.78 | — | — |
| Ethylene-propylene VI Improver | — | 19.78 | — |

-continued

| | A | B | C |
|---|---|---|---|
| Polymethacrylate VI Improver | — | — | 19.78 |
| Zn—based Universal/Multifunctional Additive Package | 1.10 | 1.10 | 1.10 |
| 210° F. Viscosity (Centistokes) | 4.71 | 7.35 | 7.67 |
| −40° F. Viscosity (Centistokes) | 2502 | >9000 | 1194 |
| Viscosity Index | 178 | 230 | >300 |

It is evident from the data that only fluid C, formulated in accordance with the present invention using a polymethacrylate VI improver, satisfies the viscometric requirements of the invention. Neither formulation A or formulation B meet the 210° F. and −40° F. viscosities required for the instantly claimed hydraulic fluids. Both the −40° F. and 210° F. viscosities of fluid A are outside the specified ranges and, while it would be possible to lower the −40° F. viscosity by changing the amount of VI improver, the 210° F. viscosity would still be below the minimum required viscosity limit. Also, the viscosity index of formulation A is significantly lower than required for the fluids of this invention. For fluid B, even if the amount of VI improver were reduced to achieve the minimum 210° F. viscosity of 5.5, the −40° F. viscosity would still be significantly higher than the 1400 centistoke maximum required for the fluids of this invention. Conversely, if the −40° F. viscosity were brought into specification, the 210° F. viscosity would be substantially below the 5.5 centistoke minimum. Shear stabilities of formulations A and B were also unacceptable, i.e., greater than 3 percent 210° F. viscosity loss, whereas formulation C gave less than 2 percent 210° F. viscosity loss when tested in accordance with ASTM D-3945B.

EXAMPLE XI

To demonstrate the criticality of the particular polymethacrylate viscosity index improver used, three formulations (D-F) were prepared by blending 79.12 parts 2 centistoke synthetic hydrocarbon, 1.10 parts zinc-based universal/multifunctional additive package (Hitec ® 9191 containing 3.3% Zn, 2.7% P and 6.0% S) and 19.72 parts polymethacrylate viscosity index improver. Different molecular weight polymethacrylate viscosity index improvers were utilized for each of the three formulations. Weight average molecular weights ($\overline{M}_w$) of the polymer fraction of the VI improvers employed were as follow:

Formulation D—55,600
Formulation E—77,746
Formulation F—135,940

Viscosities, viscosity index and shear stability (ASTM D-3945B) were determined for each formulation:

| | D | E | F |
|---|---|---|---|
| 210° F. Viscosity (Centistokes) | 5.78 | 8.62 | 11.77 |
| −40° F. Viscosity (Centistokes) | 1162 | 1164 | 1738 |
| Viscosity Index | 277 | >300 | >250 |
| Percent 210° F. Viscosity Loss | <2 | >3 | >>3 |

Only fluid D, which was formulated using a polymethacrylate VI improver in the specified molecular weight range, met the viscometric and shear stability requirements. While the viscometrics of fluid E were within the specified limits, the shear stability of the product was unacceptable. Significant loss of viscosity was observed with fluid E under conditions of shear. Even though the 210° F. and −40° F. viscosities of fluid E could be met by reducing the amount of VI improver, the shear stability of this product was also unacceptable and significantly less than required for the fluids of this invention.

EXAMPLE XII

A polymethacrylate VI improver (polymer fraction weight average molecular weight of 22,998) was employed to prepare a hydraulic fluid. For the formulation, 25.71 parts of the polymethacrylate VI improver was blended with 73.19 parts 2 centistoke synthetic hydrocarbon and 1.10 parts zinc-based universal/multifunctional additive package (Hitec® 9191). The resulting formulated fluid had the following properties:

| | |
|---|---|
| 210° F. Viscosity (Centistokes) | 5.51 |
| 100° F. Viscosity (Centistokes) | 21.44 |
| −40° F. Viscosity (Centistokes) | 1390 |
| Viscosity Index | 230 |
| Percent 210° F. Viscosity Loss (ASTM D-3945B) | <2 |

I claim:

1. A hydraulic fluid characterized by having a minimum viscosity of 5.5 centistokes at 210 °F., a maximum viscosity of 1400 centistokes at −40° F. and viscosity index of 230 or above and comprised of:

(a) 70 to 87 percent by weight of a synthetic hydrocarbon having a 210° F. viscosity of 1.6 to 2.2 centistokes and obtained from the oligomerization of 1-decene or an alpha-olefin mixture containing a major proportion of 1-decene;

(b) 12 to 30 percent by weight of a polymethacrylate viscosity index improver wherein the polymer has a weight average molecular weight of 20,000 to 70,000; and (c) 0.25 to 3.0 percent by weight of a zinc-based universal/multifunctional additive package which contains 3–8 percent zinc, 2.5–6 percent phosphorous and 5–14 percent sulphur.

2. The hydraulic fluid of claim 1 which substantially meets all the requirements of the Denison HF-O standards and has less than a 3 percent decrease in 210° F. viscosity in the ASTM D-3945B Shear Injector test.

3. The improved hydraulic fluid of claim 2 which contains 75 to 85 percent synthetic hydrocarbon, said synthetic hydrocarbon containing less than 10 percent trimer and higher oligomers, 18 to 25 percent polymethacrylate viscosity index improver, and 0.5 to 1.5 percent zinc-based universal/multifunctional additive package.

4. The hydraulic fluid of claim 3 wherein the polymethacrylate viscosity index improver has a weight average molecular weight in the range 40,000 to 65,00.

5. The hydraulic fluid of claim 4 wherein the zinc-based universal/multifunctional additive is derived from zinc dithiophosphate.

* * * * *

UNITED STATES PATENT AND TRADEMARK OFFICE

CERTIFICATE OF CORRECTION

PATENT NO. : 4,537,696

DATED : August 27, 1985

INVENTOR(S) : Bruce J. Beimesch

It is certified that error appears in the above-identified patent and that said Letters Patent are hereby corrected as shown below:

On the cover page, in the line headed [22], "Sep. 30, 1982" should read --- Sep. 30, 1983 ---.

Column 1, line 40, "forpiston" should read --- for piston ---.

Column 2, line 27, "forthese" should read --- for these ---.

Column 4, line 53, "25" should be deleted.

Column 7, line 37, "Acrloid" should read --- Acryloid ---; line 63, "follow" should read --- follows ---.

Column 10, line 25, "65,00" should read --- 65,000 ---.

Signed and Sealed this

*Seventh* Day of *January 1986*

[SEAL]

*Attest:*

DONALD J. QUIGG

*Attesting Officer*

*Commissioner of Patents and Trademarks*